US009603213B1

(12) United States Patent
Suttles et al.

(10) Patent No.: US 9,603,213 B1
(45) Date of Patent: Mar. 21, 2017

(54) CONTROLLING MULTIPLE GROUPS OF LEDS

(71) Applicant: ABL IP Holding LLC, Decatur, GA (US)

(72) Inventors: Benjamin Marshall Suttles, Stockbridge, GA (US); Daniel Aaron Weiss, Tucker, GA (US); Antonio Marques, Pittsburgh, PA (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 15/016,600

(22) Filed: Feb. 5, 2016

(51) Int. Cl.
*H05B 37/02* (2006.01)
*H05B 33/08* (2006.01)

(52) U.S. Cl.
CPC ..... *H05B 33/083* (2013.01)

(58) Field of Classification Search
CPC ..... H05B 33/0815; H05B 33/0818; H05B 41/2828; H05B 41/3921; H05B 41/3927
USPC ..... 315/291, 292, 294, 295, 307, 312
See application file for complete search history.

(56) References Cited

U.S. PATENT DOCUMENTS 6,972,755 B2 12/2005 Plangger
7,015,825 B2 3/2006 Callahan
7,202,607 B2 4/2007 Kazar et al.
7,307,614 B2 12/2007 Vinn
7,317,288 B2 1/2008 Lin et al.
7,764,028 B2 7/2010 Mariyama et al.
7,956,552 B2 6/2011 Champion et al.
8,164,276 B2 4/2012 Kuwabara
8,373,364 B2 2/2013 Santo et al.
8,427,063 B2 4/2013 Hulett
8,456,109 B1 6/2013 Wray
8,525,416 B2 9/2013 Roger et al.
8,558,782 B2 10/2013 You et al.
8,581,520 B1 11/2013 Wray et al.
8,587,212 B2 11/2013 Li et al.
8,598,809 B2 12/2013 Negley et al.
8,653,741 B2 2/2014 Monney et al.
8,659,514 B2 2/2014 Sato et al.
8,742,695 B2 6/2014 Wray
8,841,851 B2 9/2014 Cho et al.
8,890,421 B2 11/2014 Kraft
8,922,126 B2 12/2014 Bora et al.
9,018,856 B2 4/2015 Jeong
2010/0007283 A1 1/2010 Shimoyoshi et al.
(Continued)

*Primary Examiner* — Minh D A
(74) *Attorney, Agent, or Firm* — Kilpatrick Townsend & Stockton, LLP

(57) ABSTRACT

The described invention provides a method of and circuitry for driving three or more groups of light emitting diodes (LEDs) using time division multiplexing, whereby a periodic signal is divided among groups of LEDs, each with a different color or color temperature. The LEDs may be driven to produce colors along a desired path of values. Other qualities of light besides color or color temperature may be similarly controlled along a path of values. In some implementations, the system may receive an oscillating signal, which may be used as a periodic signal for comparison with the control signal, and one or more offset voltages, each of which may be combined with the oscillating signal to provide a second oscillating signal. The control signal may be compared to both of the oscillating signals to determine if a particular LED group may be powered.

15 Claims, 9 Drawing Sheets

(56) References Cited

U.S. PATENT DOCUMENTS

| | | | | |
|---|---|---|---|---|
| 2014/0320022 | A1 | 10/2014 | Lee | |
| 2014/0375213 | A1* | 12/2014 | Zhang | H05B 33/083 315/122 |
| 2015/0305098 | A1* | 10/2015 | Jung | H05B 33/0824 315/122 |

* cited by examiner

CONTROLLING MULTIPLE GROUPS OF LEDS

FIELD OF THE INVENTION

This invention and the disclosed embodiments relate to the field of color-tunable lighting fixtures, and specifically to controlling multiple sources of light of different colors or color temperatures.

BACKGROUND OF THE INVENTION

Current lighting fixtures may provide color control by driving two groups of light-emitting diodes (LEDs) using a single driver circuit. Such fixtures may rapidly alternate between the two groups of LEDs, resulting in a combined light output that is perceived by a person as an average between the outputs of the two groups. The fixtures may use time division multiplexing (TDM), whereby an oscillating circuit provides a periodic signal and some portion of the signal is sent to one group of LEDs and the remainder is sent to a second group. This provides a low-cost, low-complexity method to drive the two LED groups in complimentary ratios ranging between 1:0 and 0:1 as a control signal ranges between 0% and 100%. However, the color of the light output is limited to a straight line of values between the colors of the two LED groups. To achieve color output that more closely approximates a curve, more than two groups of LEDs need to be driven by a single control signal.

BRIEF SUMMARY

The described invention provides a method of and circuitry for driving three or more groups of LEDs using TDM, whereby a periodic signal is divided among the groups of LEDs each with a different color or color temperature. The LEDs may be driven to produce colors along a desired path of values. Other qualities of light may be similarly controlled along a path of values, if the different characteristics of the LED groups are selected based on other qualities besides color or color temperature; examples of other qualities include color rendering index, circadian stimulus, efficiency, etc.

In some implementations, the invention provides for multiplexing between three groups of LEDs such that a control signal ranging between 0% and 100% determines how the three groups of LEDs are driven. In other implementations, the invention provides for multiplexing between more than three groups of LEDs.

In one implementation, the invention may receive a control signal, such as an analog voltage signal provided by an adjustable switch. In other implementations, the control signal may alternatively be provided by a digital source. The control signal may have a range between a minimum and maximum value (e.g., from 0 to 10 volts).

In some implementations, the system may receive an oscillating signal, which may be used as a periodic signal for comparison with the control signal, to determine if a particular LED group may be powered. The waveform of the oscillating signal may be a sawtooth wave or a triangular wave, but other waveforms may alternatively be used, such as a sinusoid wave. The waveform of the oscillating signal may have a variable waveform slope, where the slope and/or overall shape of the waveform is selected based upon the desired implementation. The system may also receive one or more offset voltages, each of which may be combined with the oscillating signal to provide a second oscillating signal that is voltage-shifted from the oscillating signal. The control signal may be compared to both of the oscillating signals to determine if a particular LED group may be powered. In general, for an implementation which drives n groups of LEDs, n−2 offset voltages are required.

In certain implementations, the one or more offset voltages may be related to the control signal. In such implementations, adjustments to the control signal (e.g., increasing or decreasing the level) may cause related adjustments to the offset and thus the second oscillating signal.

In some implementations, the system may comprise comparator sub-circuits, which may compare the voltage level of the control signal to that of a particular oscillating signal. The output of such a comparator may be provided to a switch connected to a particular group of LEDs. The output of a comparator may also be combined with the output of another comparator, and the combination may then be provided to a switch connected to a particular group of LEDs. In such implementations, the comparison of the voltage level of the control signal to that of a particular oscillating signal may be used to determine if a particular LED group may be powered. In an alternative implementation, the control signal may be received by a microprocessor as an input, and the microprocessor may compare the voltage level of the received signal to a range of values. The microprocessor may then provide one or more output signals based on the results of the comparison(s), and the output signals may be used to determine if a particular LED group may be powered.

It may be appreciated that the example components described above are not the only possible implementation of the invention. Comparable results may be achieved using other configurations. Such alternate implementations will be apparent to one skilled in the art.

BRIEF DESCRIPTION OF THE DRAWINGS

FIGS. 5*a*-5*b* are collectively referred to herein as FIG. 5.

FIGS. 6*a*-6*b* are collectively referred to herein as FIG. 6.

FIGS. 7*a*-7*b* are collectively referred to herein as FIG. 7.

FIGS. 8*a*-8*b* are collectively referred to herein as FIG. 8.

FIGS. 9*a*-9*b* are collectively referred to herein as FIG. 9.

DETAILED DESCRIPTION

Figure 1:
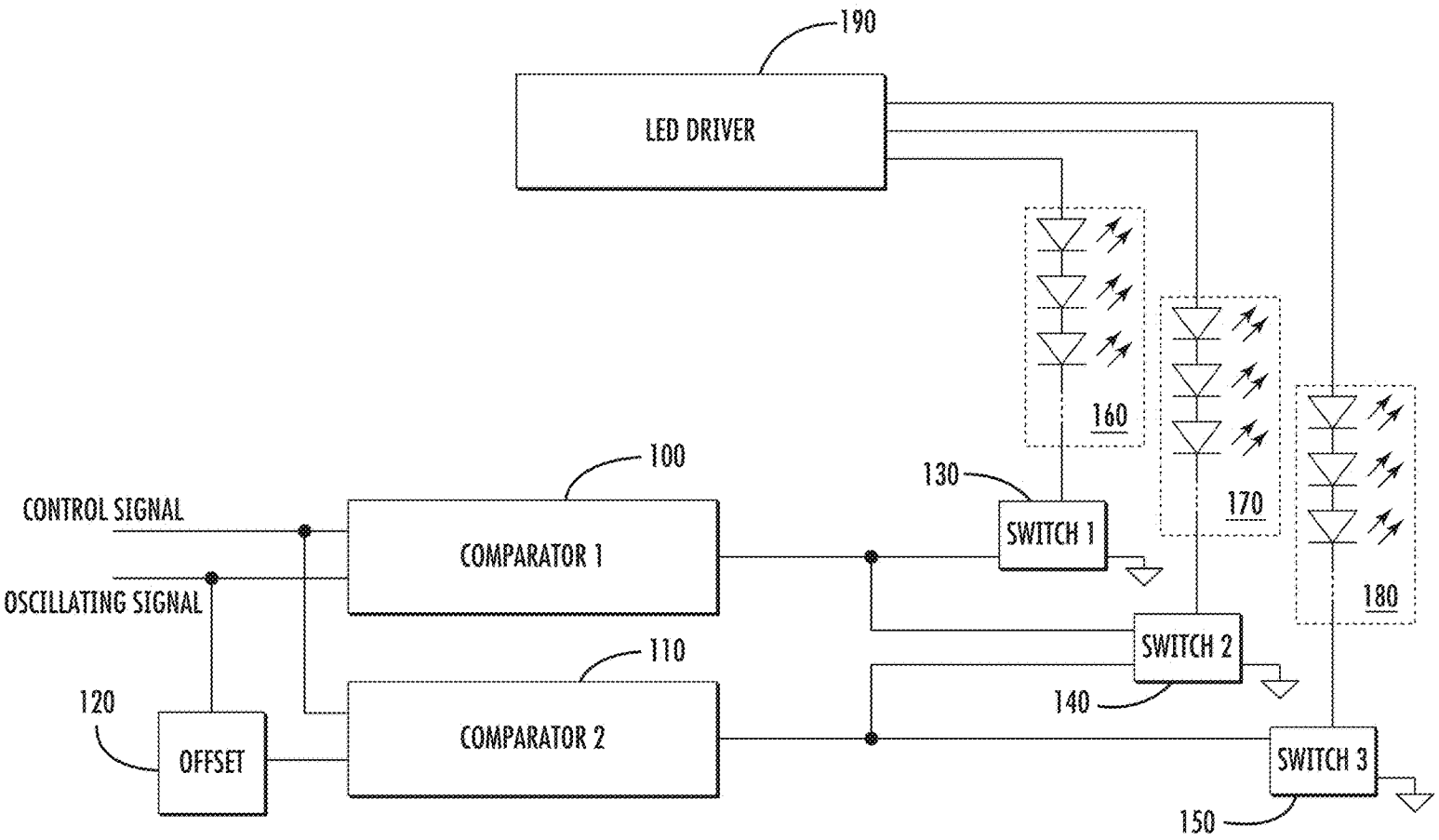
FIG. 1 is a block diagram depicting an exemplary implementation of the invention.

An example implementation of the invention is depicted in FIG. 1. A control signal may be received as an input to each of a first comparator 100 and a second comparator 110. The control signal may be analog or digital, and may have a range of values between about 0% and about 100%. An oscillating signal, such as a sawtooth waveform, may be received as a second input to the first comparator 100. The amplitude of the oscillating signal may be selected based upon the control signal range of values. The frequency of the oscillating signal may be selected to minimize perceived flicker of the light output, given constraints of circuit cost and/or complexity. The shape and/or slope of the oscillating signal may be selected to implement a non-linear response to the control signal. The oscillating signal may be combined with an offset 120 to create a second oscillating signal, and this may be received as a second input to the second comparator 110. The offset signal may have a given voltage, where the voltage selection is based upon the desired path of the light output. The offset signal may also have a time offset, where the time offset may be selected based on the circuit characteristics in a given implementation, or based upon the desired path of the light output.

Each of the comparators 100 and 110 may produce an output based on the comparison of the respective received input signals. The output of the first comparator 100 may be based on the comparison of the control signal to the oscillating signal, and the output of the second comparator 110 may be based on the comparison of the control signal to the second oscillating signal. Comparing the control signal to either of the oscillating signals may produce an output that has a first value, e.g., high, when the oscillating signal is greater than the control signal and has a second value, e.g., low, when the oscillating signal is less than the control signal. For a constant control signal, the comparator outputs may comprise a signal that has a periodic cycle that corresponds to the oscillating signal.

The output signals of the first and second comparators may be used as inputs for switches 130, 140, and 150. The switches may be implemented using transistors, or any other suitable switching component. Each of the switches 130, 140, and 150 may control a group or segment of LEDs 160, 170, and 180 respectively. In the depicted exemplary configuration, the first switch 130 may receive the output of the first comparator 100 as an input and may power LED segment 160 when the output has a first value, i.e., when the oscillating signal is greater than the control signal. The second switch 140 may receive the output of the first and second comparators 100 and 110 as inputs and may power the LED segment 170 when the output of the first comparator has a second value and the output of the second comparator has a first value, i.e., when the oscillating signal is less than the control signal and the second oscillating signal is greater than the control signal. The third switch 150 may receive the output of the second comparator 110 as an input and may power the LED segment 180 when the output has a second value, i.e., when the control signal is greater than the second oscillating signal.

Figure 2:
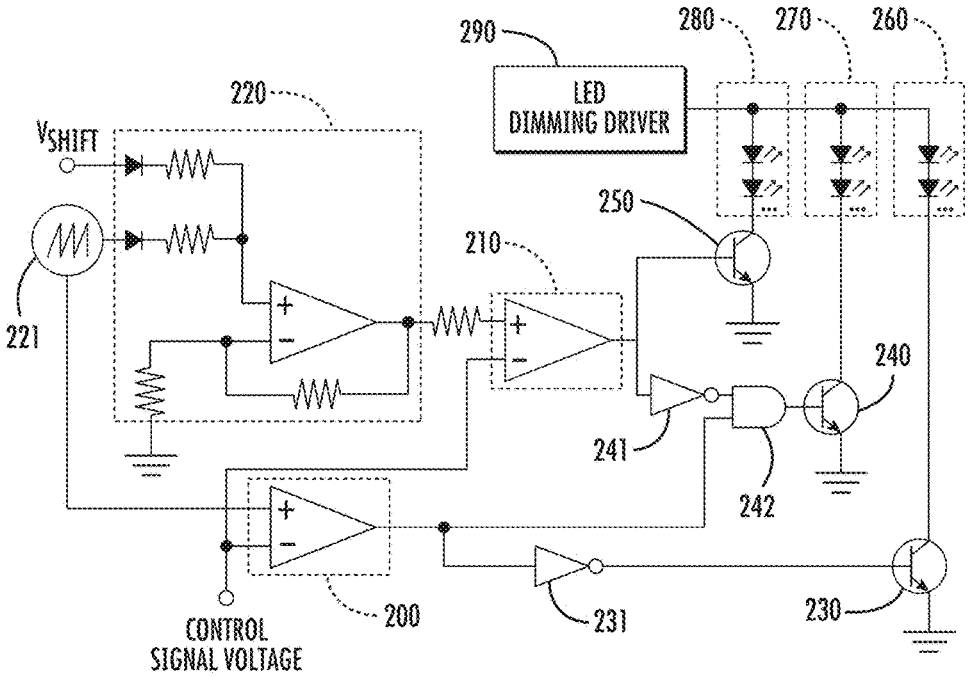
FIG. 2 is a block diagram of an exemplary implementation using analog circuit components.

In FIG. 2, an example implementation using analog circuit components is depicted. The oscillating signal may be received from a signal generator 221. A voltage signal $V_{shift}$ also may be received. Both the oscillating signal and the voltage signal $V_{shift}$ may be received as inputs to a summing sub-circuit 220, and the summation of these signals may be output as a second oscillating signal. The summing sub-circuit 220 may have the example configuration depicted in FIG. 2, but may also be implemented with any suitable set of analog components.

A control signal may be received at the inverting input on each of a first comparator 200 and a second comparator 210. The control signal may have a range of analog values, such as between about 0V and about 10V. The oscillating signal from signal generator 221 may be received at the non-inverting input of first comparator 200, and the second oscillating signal from the summing sub-circuit 220 may be received at the non-inverting input of second comparator 210. Each of the comparators 200 and 210 may produce an output based on the comparison of the respective received input signals. The output of the first comparator 200 may be based on the comparison of the control signal to the oscillating signal, such that the comparator output is high when the control signal is greater than the oscillating signal. The output of the second comparator 210 may be based on the comparison of the control signal to the second oscillating signal, such that the comparator output is high when the control signal is greater than the second oscillating signal.

The outputs of the comparators may be used as inputs for switches 230, 240, and 250 to control LED segments 260, 270, and 280 respectively. Transistors are shown as the switch components but any solid state switching device could be used. The switch inputs may also comprise inverted or combined comparator outputs, such as from inverters 231 and 241 or logical AND 242. In the depicted exemplary implementation, the output of the first comparator 200 may be inverted by inverter 231, and the first switch 230 may receive the inverted signal as an input. In this configuration, the LED segment 260 is powered while the oscillating signal is greater than the control signal. For the second switch 240, the output of first comparator 200 and the inverted output of second comparator 210 may be combined at a logical AND gate 242, such that the LED segment 270 is powered while the oscillating signal is less than the control signal and the second oscillating signal is greater than the control signal. The third switch 250 may receive the output of the second comparator 210 as an input, such that the LED segment 280 is powered while the control signal is greater than the second oscillating signal. An LED driver 290 may provide a single-channel current to drive the three LED segments.

Figure 3:
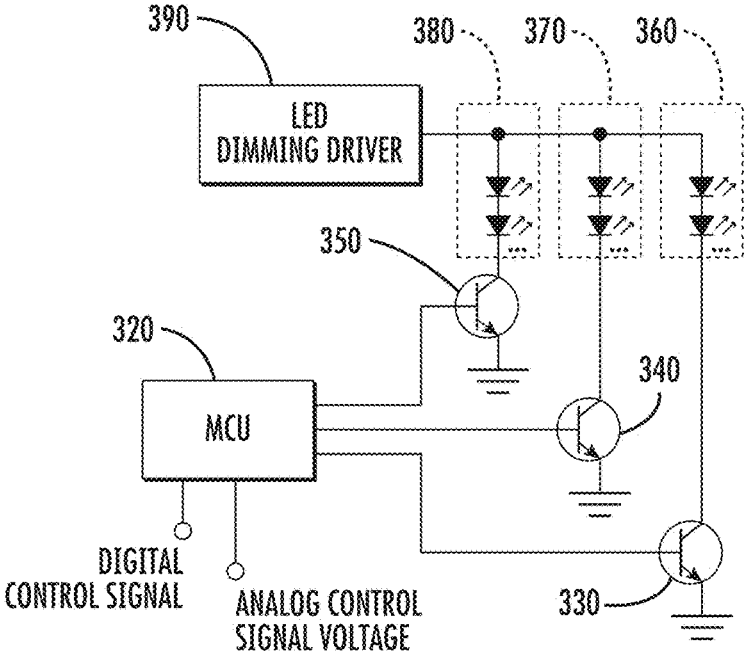
FIG. 3 is a block diagram of an exemplary implementation using a microcontroller.

In FIG. 3, an example implementation using a programmed microcontroller is depicted. In this type of configuration, a control signal may be received as an input to the microcontroller 320. The control signal may be analog or digital, and may have a range of values between about 0% and about 100%. The microcontroller 320 may compare the level of the received control signal to a range of values, using programmed logic such as described in FIG. 4. Based on the comparison, the microcontroller 320 may then provide an output signal to each of switches 330, 340, and 350, to control LED segments 360, 370, and 380 respectively. An LED driver 390 may provide a single-channel current to drive the three LED segments. The microcontroller may provide the outputs such that only one LED segment is powered at a time.

Figure 4:
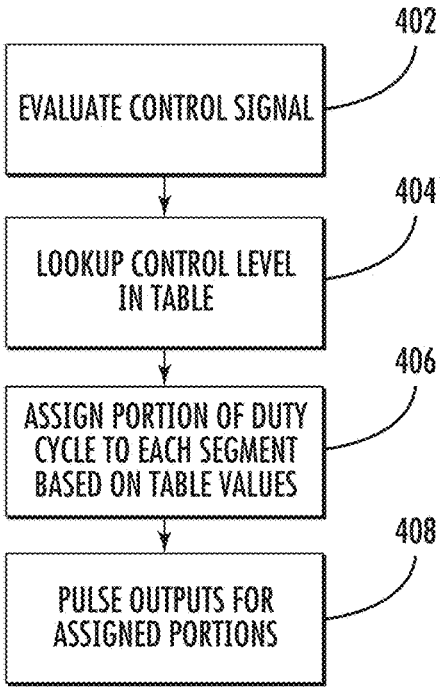
FIG. 4 is a flow chart depicting an exemplary method of programming a microcontroller.

FIG. 4 depicts an example method by which the microcontroller 320 may provide outputs to the switches. Upon receiving a control signal, the microcontroller may evaluate the signal at block 402 to determine the signal level. After evaluation of the signal, the microcontroller at block 404 may compare the level to a predetermined range of values, such as in a lookup table, to determine how to drive each LED segment. After determining how to drive each of the LED segment, the microcontroller at block 406 may determine a duty cycle for each signal used to drive the LED segments. The period of each signal may correspond to an oscillating signal internal or external to the microcontroller.

After the duty cycle for each signal is determined, the microcontroller 320 at block 408 may provide the signals to the appropriate switch. The switches may control the LED segments based on the provided inputs, such that each LED segment provides light output corresponding to the control signal. The example method may also comprise steps for error handling, such as producing a default color, e.g., white light, if the control signal is not received; such steps are omitted for clarity, but are deemed to be within the scope of the invention.

Figure 5A:
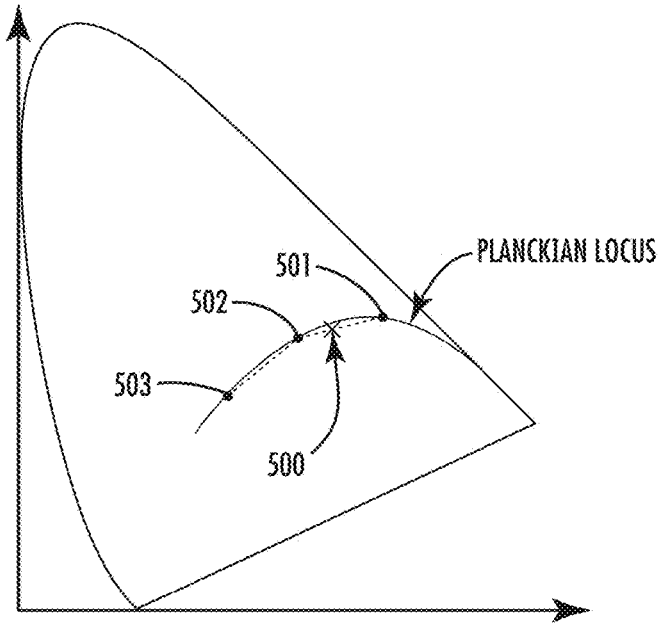
FIG. 5*a* illustrates exemplary outputs and FIG. 5*b* illustrates exemplary waveforms for selecting LED segments.
Figure 5B:
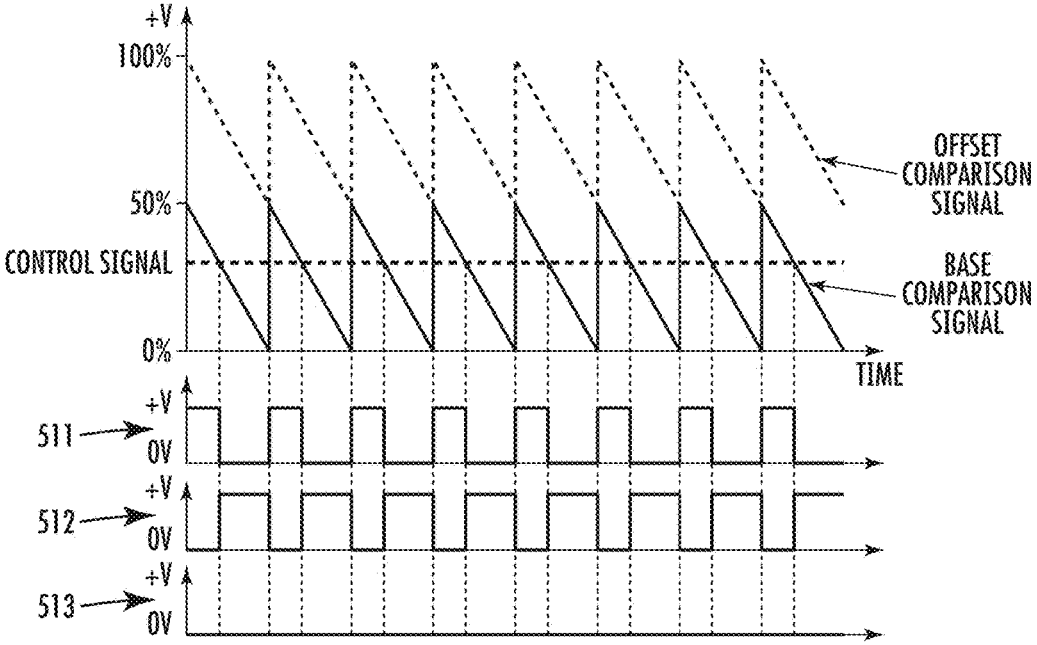
Figure 6A:
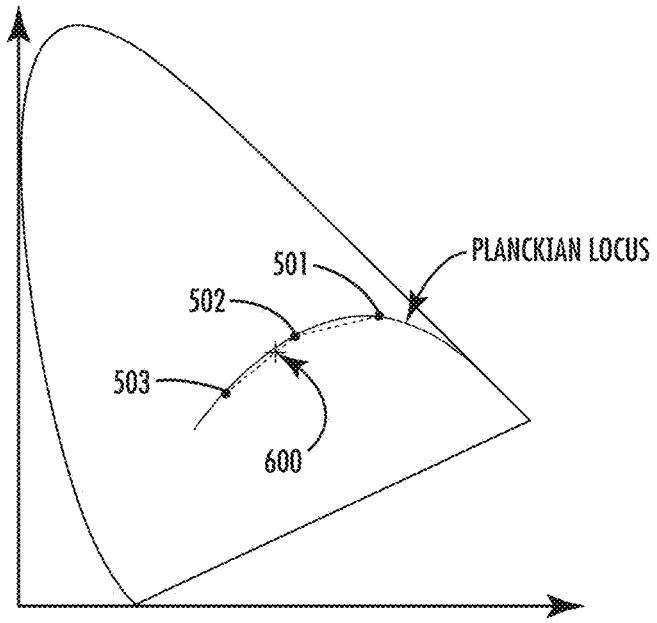
FIG. 6*a* illustrates exemplary outputs and FIG. 6*b* illustrates exemplary waveforms for selecting LED segments.
Figure 6B:
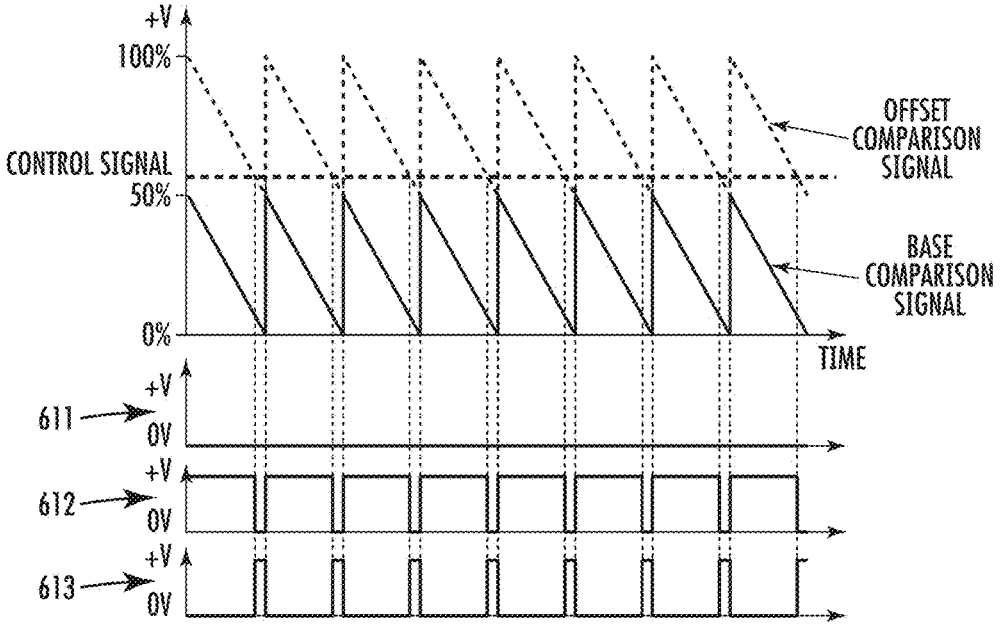

Turning now to FIGS. 5 and 6, the color output is considered for LED segments multiplexed using one of the implementations described above. In FIGS. 5*a* and 6*a*, a simplified chart for the CIE 1931 color space is shown; the enclosed space represents all colors that may be seen by the human eye. The curved line indicates the Planckian locus, along which occur colors considered to be "white light." In this example, individual LED segments 501, 502, and 503 may produce light at the indicated points along the Planckian locus. Other configurations may include LED segments of any color. The path, or range of values possible in the example implementation, for the combined light output of the multiplexed segments is shown as a dashed line. In FIGS. 5*b* and 6*b*, exemplary waveforms are depicted for the oscillating signal (labeled as Base Comparison Signal) and the second oscillating signal (labeled as Offset Comparison Signal); an exemplary level of a control signal is also depicted (dashed line). FIGS. 5*b* and 6*b* also depict the duty cycle of each signal used to control the LED segments, where the duty cycle corresponds to the relative levels of the control signal and the oscillating signals.

In this example, the control signal may be adjusted to 30% of its maximum value, as shown in FIG. 5*b*. The level of the control signal may be less than the value of the oscillating signal for a first portion of the waveform cycle, and greater than the value of the oscillating signal for the second portion of the waveform cycle. The control signal may also be less than the value of the second oscillating signal throughout the entire waveform cycle. Based on the compared values of the control signal and the oscillating signals, an output may be provided to control the LED segment 501, such that the segment remains powered during the first portion of the wave cycle, and powered off during the second portion (depicted in duty cycle 511). Also based on the compared values, an output may also be provided to control the LED segment 502, such that segment may be powered off during the first portion of the wave cycle, and powered for the second portion (depicted in duty cycle 512). Further based on the compared values, an output may be provided to control the LED segment 503, such that the segment may be powered off throughout the waveform cycle (depicted in duty cycle 513). In these conditions, the overall output of the LED segments may be a combination of the segment 501 being powered for a first portion of the wave cycle and the segment 502 being powered for the second portion of the cycle, while the segment 503 may not be powered. The resulting perceived color temperature of the light output may be represented at about point 500 on FIG. 5*a*.

In a further example, the control signal may be adjusted to 55% of its maximum value, as shown in FIG. 6*b*. In this condition, the level of the control signal may be greater than the oscillating signal throughout the waveform cycle, and the resulting output may cause the LED segment 501 to be powered off. Also, the control signal may be less than the second oscillating signal for a first portion of the waveform cycle, and greater than the second oscillating signal for a second portion of the cycle. The resulting output may be provided to the LED segment 502, such that the segment may be powered for the first portion of the waveform cycle. Furthermore, an output may be provided to control the LED segment 503 such that the segment may be powered for the second portion of the waveform cycle. In these conditions, the overall output of the LED segments may be a combination of segment 502 being powered for the first portion of the wave cycle (depicted in duty cycle 612), and segment 503 being powered for the second portion of the cycle (depicted in duty cycle 613), while segment 501 may not be powered (depicted in duty cycle 611). The resulting perceived color temperature of the light output may be represented at about point 600 on FIG. 6*a*.

Consideration of the examples shown in FIGS. 5 and 6 shows that the light output path of the multiplexed segments is based in part upon the relative amplitude and offset values of the multiple oscillating signals. In the examples shown in these figures, the amplitude of the oscillating signal may be selected to be 50% of the total range of the control signal level, and the offset of the second oscillating signal may be selected to be the same value (i.e., the highest value of the oscillating signal may be equal to the lowest value of the second oscillating signal). Given these example selections, as the level of the control signal ranges between about 0% and about 100%, the light output of the multiplexed segments is as described: at about 0%, the light output is only the color temperature of segment 501; at levels between about 0% and about 50%, the light output is a blend of the color temperatures of segments 501 and 502; at 50%, the light output is only the color temperature of segment 502; between about 50% and about 100%, the light output is a blend of the colors of segments 502 and 503; and at about 100%, the light output is only the color of segment 503. This example path of the light output is shown as the dashed line connecting the points representing segments 501, 502, and 503 on FIG. 5*a*. Other selections of values for the multiple oscillating signals may result in other light output as the control signal is varied. In an alternative example implementation (not shown), the amplitude of the oscillating signal and the voltage of the offset may be selected to be 65% of the total control signal range. In this example, the light output is only the color of segment 501 at about 0%, is a blend of the colors of segments 501 and 502 between about 0% and about 65%, is only the color of segment 502 at a control signal level of about 65%, is a blend of the colors of segments 502 and 503 between about 65% and about 100%, and is only the color of segment 503 at about 100%. In a further alternative example implementation (not shown), the amplitude of the oscillating signal may be selected to be 25% of the total control signal range, and the offset may be selected to be 75% of the total range. In this example, the light output is only the color of segment 501 at about 0%, is a blend of the colors of segments 501 and 502 between about 0% and about 25%, is only the color of segment 502 for control signal levels between about 25% and about 75%, is a blend of the colors of segments 502 and 503 between about 75% and about 100%, and is only the color of segment 503 at about 100%. Further alternative examples are described in regards to FIGS. 7, 8, and 9.

Figure 7A:
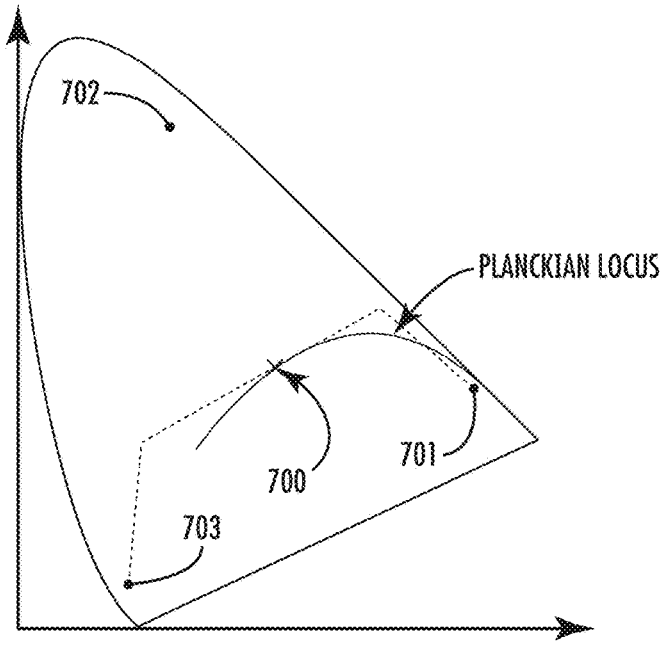
FIG. 7*a* illustrates exemplary outputs and FIG. 7*b* illustrates exemplary waveforms for selecting LED segments.
Figure 7B:
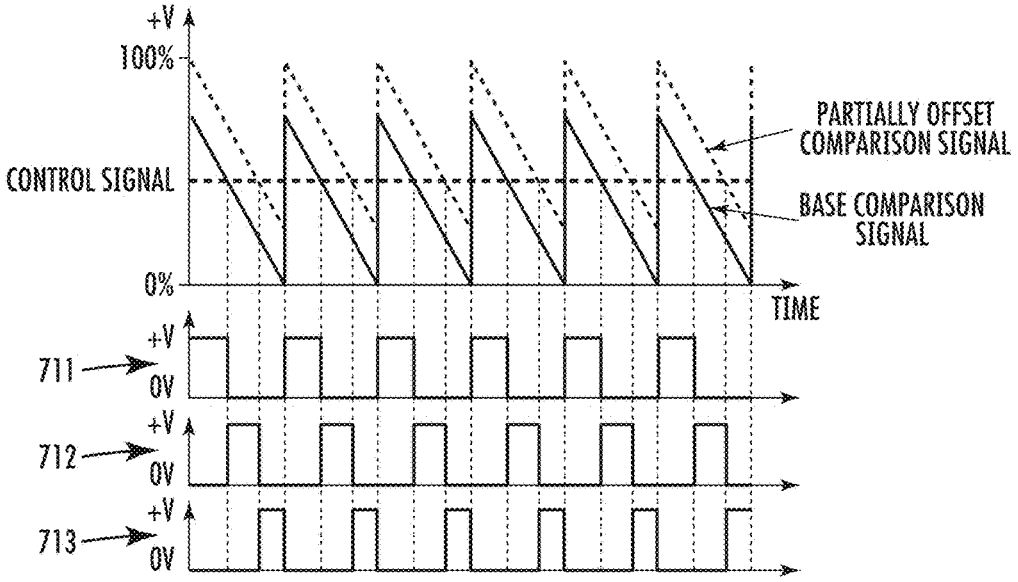

FIG. 7 depicts the color output for a different example implementation of multiplexed LED segments, wherein the oscillating signals overlap. For an implementation of this type, there may be a range of control signal levels where all LED segments may be powered for a portion of the waveform cycle, based on the relative offset of the oscillating signals of that particular implementation. FIG. 7*a* depicts the simplified CIE 1931 color space chart and Planckian locus, with the light output points indicated for example LED segments 701, 702, and 703. In this example, the path for the combined light output of multiplexed segments 701, 702, and 703 is shown as a dashed line. In FIG. 7*b*, exemplary waveforms are depicted for the oscillating signal (labeled as Base Comparison Signal) and the second oscillating signal (labeled as Partially Offset Comparison Signal); in this example, the second oscillating signal is offset such that its lowest value is less than the highest value of the oscillating signal. An exemplary level of a control signal is also depicted (dashed line). FIG. 7*b* also depicts the duty cycle of each signal used to control the LED segments.

In this example implementation, the control signal may be adjusted to 50% of its maximum value, as shown in FIG. 7*b*. For a first portion of the waveform cycle, the level of the control signal may be less than the values of the oscillating signal and the second oscillating signal. For a second portion of the waveform cycle, the control signal may be greater than the value of the oscillating signal, and less than the value of the second oscillating signal. For a third portion of the cycle, the control signal may be greater than the values of the oscillating signal and the second oscillating signal. Outputs may be provided to control the LED segments as described above, such that segment 701 may be powered during the first portion of the waveform cycle (depicted in duty cycle 711), segment 702 may be powered during the second portion of the cycle (depicted in duty cycle 712), and segment 703 may be powered during the third portion (depicted in duty cycle 713). In these conditions, the overall output of the LED segments may be a combination of the segments each being powered for a particular portion of the cycle. The resulting perceived color temperature of the light output may be represented at about point 700 on FIG. 7*a*.

Consideration of the example implementation shown in FIG. 7 shows that the light output path of the multiplexed segments may be based in part upon overlap between the relative amplitude and offset values of the multiple oscillating signals. In the example shown here, the amplitude of the oscillating signal may be selected to be about 75% of the total range of the control signal level, and the offset of the second oscillating signal may be selected to be about 25% of the total range (i.e., the lowest value of the second oscillating signal is at about 25% of the range). Given these example selections, as the level of the control signal ranges between about 0% and about 100%, the light output of the multiplexed segments is as described: at about 0%, the light output is only the color of segment 701; at levels between about 0% and about 25%, the light output is a blend of the colors of segments 701 and 702; between about 25% and about 75%, the light output is a blend of the colors of segments 701, 702, and 703; between about 75% and about 100%, the light output is a blend of the colors of segments 702, and 703; and at about 100%, the light output is only the color of segment 703. This example path of the light output is shown as the dashed line on FIG. 7*a*. It may be observed that in this example, the path does not include the point representing segment 702, as there is no level of the control signal where the light output is only the color of segment 702.

Figure 8A:
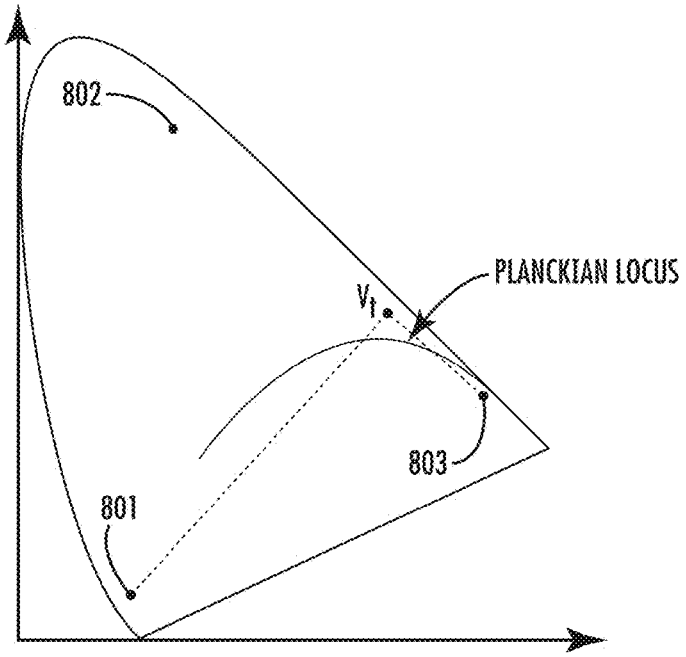
FIG. 8*a* illustrates exemplary outputs and FIG. 8*b* illustrates exemplary waveforms for selecting LED segments.
Figure 8B:
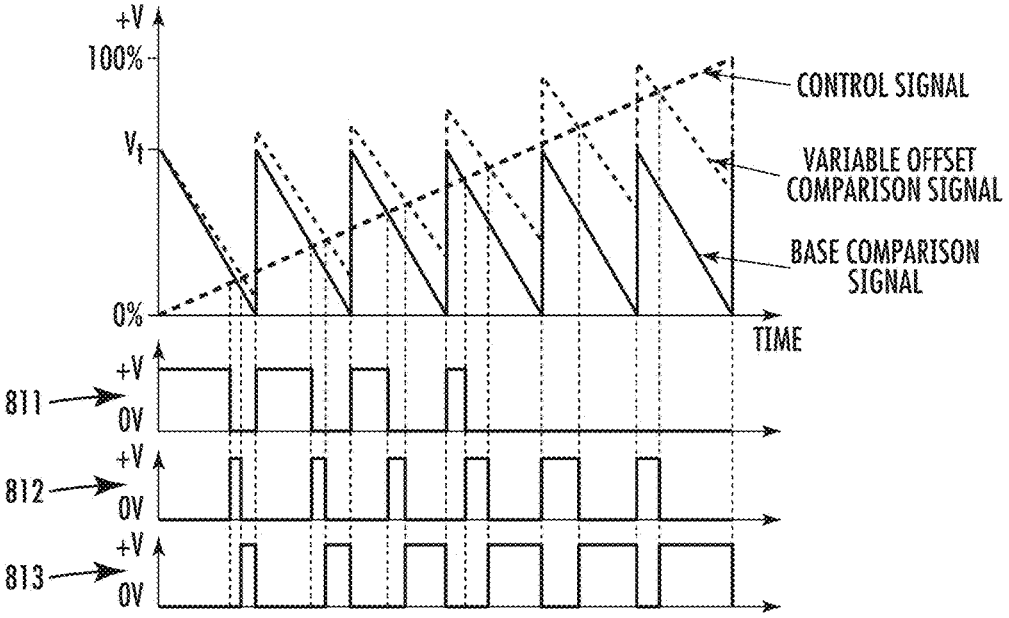

FIG. 8 depicts the color output for a further example implementation of multiplexed LED segments, wherein the second oscillating signal may have a variable offset. For an implementation of this type, there may be a range of control signal levels where all LED segments may be powered for a portion of the waveform cycle, and a range where only some of the LED segments may be powered for a portion of the cycle. FIG. 8*a* depicts the simplified CIE 1931 color space chart and Planckian locus, with the light output points indicated for example LED segments 801, 802, and 803. In this example, the path for the combined light output of multiplexed segments 801, 802, and 803 is shown as a dashed line. In FIG. 8*b*, exemplary waveforms are depicted for the oscillating signal (labeled as Base Comparison Signal) and the second oscillating signal (labeled as Variable Offset Comparison Signal). In this implementation, the second oscillating signal has an offset that may be based on the current level of the control signal (dashed line); for example, the offset may be 50% of the level of the control signal. Such a relation between the signals may cause the second oscillating signal to adjust as the value of the control signal is adjusted. FIG. 8*b* also depicts the duty cycle 811, 812, and 813 of each signal that controls an LED segment. In this example implementation, as the control signal is adjusted across its range, as shown in FIG. 8*b*, the duty cycles of the signals may change proportion at a faster or slower rate, than if the second oscillating signal had a constant offset. Outputs may be provided to control the LED segments as described above, such that the overall output of the LED segments may be a combination of the segments each being powered for a particular portion of the cycle. In these conditions, as the level of the control signal is adjusted, the resulting perceived color of the light output may be represented by the range of values shown as a dashed line in FIG. 8*a*.

Consideration of the example implementation shown in FIG. 8 shows that the light output path of the multiplexed segments may be selected based in part upon variation of the relative amplitude and offset values of the multiple oscillating signals. In the example shown here, the amplitude of the oscillating signal may be selected to be at the level $V_t$ relative to the total range of the control signal level, and the offset of the second oscillating signal may be selected to about 50% of the control signal. Given these example selections, as the level of the control signal ranges between about 0% and about level $V_t$, the light output of the multiplexed segments is a blend of the colors of segments 801, 802, and 803; between about level $V_t$ and about 100%, the light output is a blend of the colors of segments 802, and 803; and at about 100%, the light output is only the color of segment 803. This example path of the light output is shown as the dashed line on FIG. 8*a*. The level $V_t$ is represented on FIG. 8*a* as the point $V_t$ at which the path changes from being a blend of all three example segments to a blend of only segments 802 and 803.

Figure 9A:
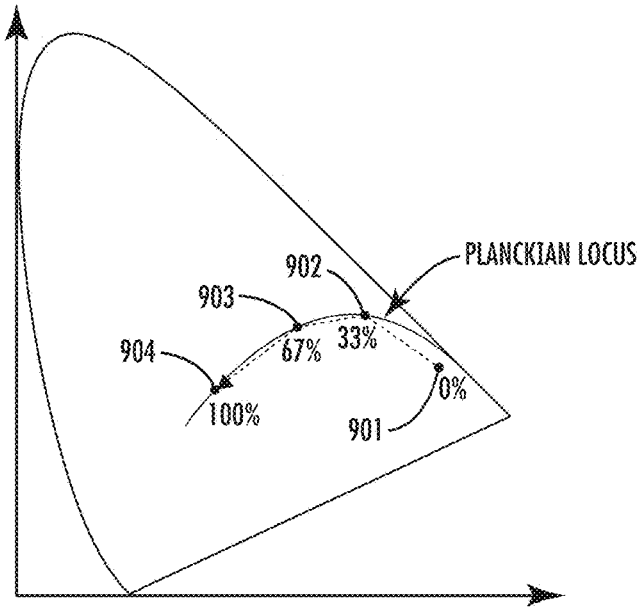
FIG. 9*a* illustrates exemplary outputs and FIG. 9*b* illustrates exemplary waveforms for selecting LED segments.
Figure 9B:
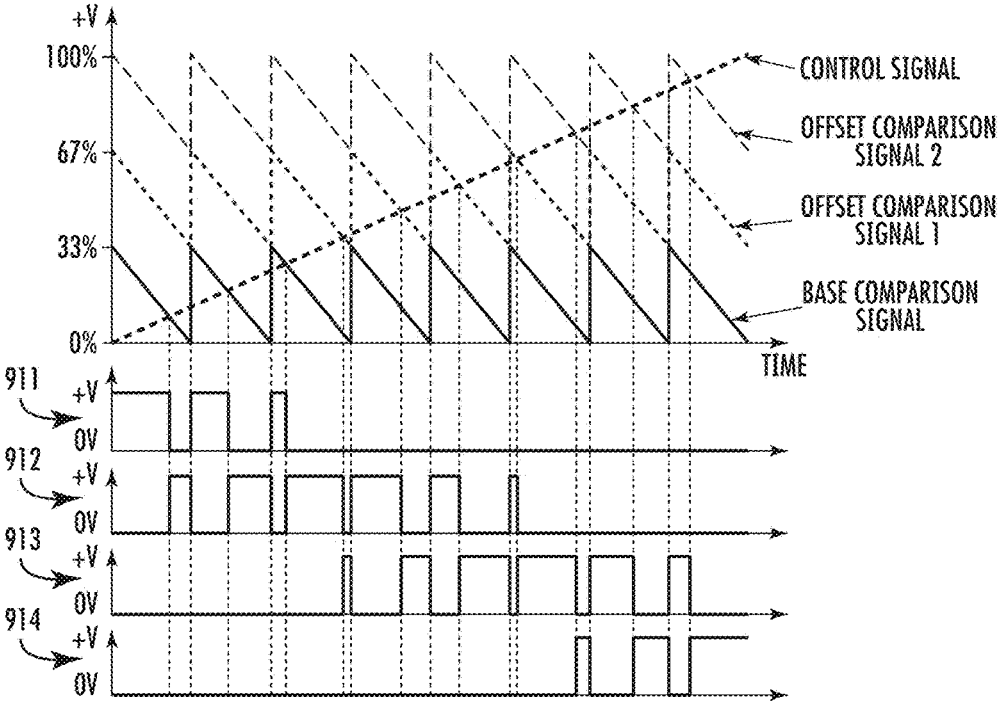

The circuit topologies may be expanded to accommodate any number of LED segments. An additional LED segment may be implemented with an additional oscillating signal and offset, and an additional comparator and necessary inverters or logical gates. In general, for an implementation which drives n groups of LEDs, n−2 offset voltages are required. The addition of further LED segments allows the possible range of values for the combined light output of the multiplexed segments to encompass more values, such as more closely approximating a curved line. FIG. 9 depicts the color output for a further example implementation of four multiplexed LED segments. FIG. 9*a* depicts the simplified CIE 1931 color space chart and Planckian locus, with the light output points indicated for example LED segments 901, 902, 903, and 904. The path for the combined light output of these multiplexed segments is shown as a dashed line, which may more closely approximate the Planckian locus. Other selections of light output points for the segments may result in other paths, such as a zigzag or closed loop of values. In FIG. 9*b*, exemplary waveforms are depicted for the oscillating signal (labeled as Base Comparison Signal), the second oscillating signal (labeled as Offset Comparison Signal 1), and a third oscillating signal (labeled as Offset Comparison Signal 2). An exemplary level of a control signal is also depicted (dashed line). FIG. 9*b* also depicts the duty cycle of each signal that controls the LED segments.

In this example implementation, as the control signal is adjusted across its range of values, as shown in FIG. 9*b*, the level of the control signal may be compared to a particular oscillating signal. For a first portion of the waveform cycle, the level of the control signal may be less than the values of all oscillating signals, while for a second portion of the waveform cycle, the control signal may be greater than the oscillating signal, and less than the remaining oscillating signals. In this condition, an output may be provided to drive an LED segment 901 during the first portion of the waveform cycle (depicted in duty cycle 911), and to drive an LED segment 902 during the second portion of the waveform cycle (depicted in duty cycle 912). If the control signal is adjusted to a different level, the level may be greater than the oscillating and second oscillating signals and less than a third oscillating signal during a first portion of the waveform cycle, and greater than all oscillating signals during a second portion of the waveform cycle. In this condition, an output may be provided to drive an LED segment 903 during the first portion (depicted in duty cycle 913), and to drive an LED segment 904 during the second portion (depicted in duty cycle 914). FIG. 9*b* depicts the output duty cycle of each signal. In this implementation, as the level of the control signal is adjusted, the resulting perceived color of the light output may be represented by the range of values shown as a dashed line in FIG. 9*a*.

Consideration of the example implementation shown in FIG. 9 shows that the light output path of the multiplexed segments may be based in part upon any number of LED segments. In the example shown here, the amplitude of the oscillating signal may be selected to be 33% of the total range of the control signal level, and the offset of the second oscillating signal may be selected to about 33% of the range of the control signal, and the offset of the third oscillating signal may be selected to be about 67% of the range of the control signal. Given these example selections, the light output of the multiplexed segments is as described: at control signal levels of about 0%, the light output is only the color of segment 901; at levels between about 0% and about 33%, the light output is a blend of the colors of segments 901 and 902; at 33%, the output is only the color of segment 902; between about 33% and about 67%, the light output is a blend of the colors of segments 902 and 903; at 67%, the output is only the color of segment 903; between about 67% and about 100%, the output is a blend of the colors of segments 903 and 904; and at about 100%, the light output is only the color of segment 904. This example path of the light output is shown as the dashed line connecting the points representing segments 901, 902, 903, and 904 on FIG. 9*a*. It may be noted that the amplitude and offset of each oscillating signal may be selected independently of every other oscillating signal to achieve a desired light output path. For example, the offset of the second oscillating signal may be selected such that there is no overlap with the first, but the offset of the third oscillating signal may be selected such that there is overlap with the second. The amplitude of each oscillating signal may also be adjusted such that there is or is not overlap with additional oscillating signals.

The waveform shape of the oscillating signal may be selected to implement a particular response to the control signal. For example, if the provided oscillating signal is a sawtooth wave with constant slope (such as depicted in FIG. 5*b*, for example), the proportion of the driver output provided to control the LED segments may vary linearly with the control signal. If the provided oscillating signal has a modified waveform with variable slope, then the proportion of the driver output provided to control the LED segments may vary relative to the control signal in a non-linear fashion. For example, as the control input varies, the driver output may vary in a more responsive manner at certain levels of the control signal, and may vary in a less responsive manner at certain other levels of the control signal—e.g., a very steep slope of the oscillating signal may result in the driver output varying more slowly as the control signal changes, and a more level slope may result in the driver output varying more quickly as the control signal changes.

Figure 10:
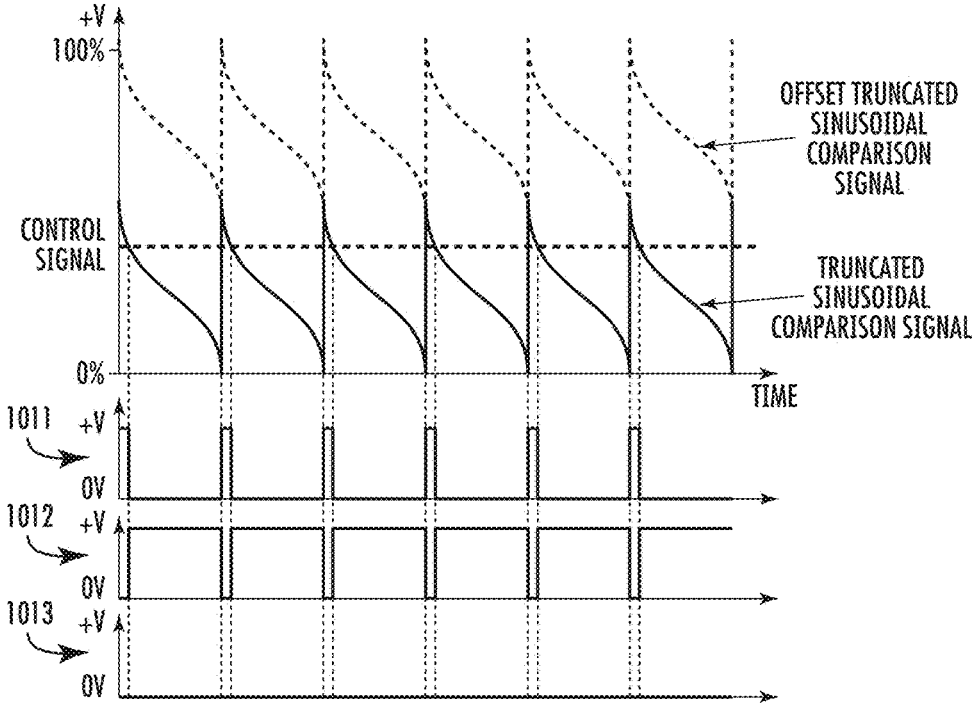
FIG. 10 illustrates exemplary waveforms for selecting LED segments.

A non-limiting example implementation of this type could comprise three LED segments of different color temperatures (e.g., about 2000 K, about 3500 K, and about 5000 K) that is expected to primarily operate at a certain range (e.g., about 3000 K-4000 K), with the ability to occasionally go higher or lower (e.g., up to about 5000 K or down to about 2000 K). A non-limiting example of an oscillating signal with a variable slope is a truncated sinusoidal wave. FIG. 10 depicts exemplary waveforms for such an oscillating signal (labeled as Truncated Sinusoidal Comparison Signal), and a second oscillating signal (labeled as Offset Truncated Sinusoidal Comparison Signal 1). An exemplary level of a control signal is also depicted (dashed line). FIG. 10 also depicts the duty cycle of each signal that controls the LED segments, such that duty cycle 1011 depicts the driver output to the first LED segment (e.g., about 2000 K), duty cycle 1012 depicts the driver output to the second LED segment (e.g., about 3500 K), and duty cycle 1013 depicts the driver output to the third LED segment (e.g., about 5000 K).

In this example, the oscillating signal may have a relatively steep slope at levels of the control signal at and around 50%, which may result in the driver output varying the duty cycle 1012 more slowly. This may result in the second LED segment remaining mostly powered while the control signal level is at or around 50%, such that the overall output of the light fixture remains close to the color temperature of the second LED segment (e.g., about 3500 K). The output of the example implementation could be "fine-tuned" in the example primary operation range (e.g., 3000 K-4000 K).

The implementations described herein are examples, and the features of different implementations may be combined to achieve many different light output path possibilities, without departing from the described invention. For all of the provided examples and figures, the values, and ranges are exemplary only, and may be changed without departing from the scope of the invention. The depicted and described light outputs of the LED segments are exemplary, and different light outputs may be used without departing from the described invention.

The foregoing descriptions and examples are provided for purposes of illustrating, explaining, and describing aspects of the present invention. Further modifications and adaptations to these examples will be apparent to those skilled in the art and may be made without departing from the scope of the invention. The exemplary systems and methods represented here may be implemented independently, in conjunction with a different one of the systems described, or in conjunction with a system not described herein.

What is claimed is:

1. A circuit for controlling a plurality of LED segments, comprising:

a first input for receiving a control signal;

a second input for receiving an oscillating signal;

a first comparator for comparing the control signal and the oscillating signal;

a second comparator for comparing the control signal and a second oscillating signal, wherein the second oscillating signal is based on the oscillating signal and an offset, wherein the offset and the oscillating signal are inputs to a summing circuit;

a first switch for controlling a first LED segment, wherein an output of the first comparator controls the first switch so that the first LED segment is powered when both the oscillating signal and the second oscillating signal exceed the control signal;

a second switch for controlling a second LED segment, wherein the output of the first comparator and an output of the second comparator control the second switch so that the second LED segment is powered when the control signal exceeds the oscillating signal and the second oscillating signal exceeds the control signal;

a third switch for controlling a third LED segment, wherein the output of the second comparator controls the third switch so that the third LED segment is powered when the control signal exceeds both the oscillating signal and the second oscillating signal, wherein the first LED segment, the second LED segment, and the third LED segment each have a different characteristic.

2. The circuit of claim 1, further comprising:

an LED driver with an output, wherein the output drives the first LED segment.

3. The circuit of claim 1, wherein the different characteristic of each of the first, second, and third LED segments is selected based on one of: a color, a color temperature, a color rendering index, a circadian stimulus, an efficiency.

4. The circuit of claim 1, wherein the oscillating signal is one of a sawtooth signal and a triangle signal.

5. The circuit of claim 1, wherein the oscillating signal is a composite of waveforms.

6. The circuit of claim 1, wherein the offset is based on the control signal.

7. The circuit of claim 1, wherein the control signal is a voltage between 0V and 10V.

8. A method for controlling a plurality of LED segments, comprising:

receiving a control signal;

comparing the control signal to an oscillating signal and to a second oscillating signal, wherein the second oscillating signal is based on the oscillating signal and a predetermined offset, wherein the oscillating signal and the predetermined offset are inputs to a summing circuit;

controlling a first LED segment, wherein the first LED segment is powered when both the oscillating signal and the second oscillating signal exceed the control signal;

controlling a second LED segment, wherein the second LED segment is powered when the control signal exceeds the oscillating signal and the second oscillating signal exceeds the control signal;

controlling a third LED segment, wherein the third LED segment is powered when the control signal exceeds both the oscillating signal and the second oscillating signal, wherein the first LED segment, the second LED segment, and the third LED segment each have a different characteristic.

9. The method of claim 8, wherein the different characteristic of each of the first, second, and third LED segments is selected based on one of: a color, a color temperature, a color rendering index, a circadian stimulus, an efficiency.

10. The method of claim 8, wherein the offset is less than an amplitude of the oscillating signal.

11. The method of claim 8, wherein the offset is approximately equal to a peak-to-peak amplitude of the oscillating signal.

12. The method of claim 8, wherein a maximum level of the control signal is approximately twice a peak-to-peak amplitude of the oscillating signal.

13. The method of claim 8, wherein a maximum amplitude of the oscillating signal is equal to or less than the maximum level of the control signal.

14. A The method of claim 8, wherein the offset is based on the control signal.

15. The method of claim 8, wherein the level of the control signal varies during a period of the oscillating signal.

* * * * *